US005727489A

United States Patent [19]

Braverman

[11] Patent Number: 5,727,489

[45] Date of Patent: Mar. 17, 1998

[54] METHOD OF MAKING A CHILD'S ACCESSORY

[76] Inventor: Enrique Braverman, Parques de Marbella #28 Parques De La Herradura, Edo de Mexico, Mexico, 52760

[21] Appl. No.: 668,305

[22] Filed: Jun. 25, 1996

[51] Int. Cl.[6] ..... D05B 13/00

[52] U.S. Cl. ..... 112/475.04; 112/475.08; 112/441

[58] Field of Search ..... 112/475.04, 475.06, 112/475.08, 475.09, 475.11, 405, 417, 440, 441, 10, 122, 129; 2/159, 158, 49.4, 49.1, 202, 169, 84, 125; 223/39, 4; 15/227; 101/127.1; 446/391

[56] References Cited

U.S. PATENT DOCUMENTS

| | | | |
|---|---|---|---|
| 2,756,448 | 7/1956 | Werbe | 15/227 X |
| 4,324,004 | 4/1982 | Smith et al. | 112/475.09 X |
| 4,463,697 | 8/1984 | Vogt et al. | 112/475.06 X |
| 5,009,626 | 4/1991 | Katz | 446/391 |
| 5,046,980 | 9/1991 | Tai et al. | 2/494.4 X |
| 5,047,001 | 9/1991 | Willis | 112/475.08 X |

FOREIGN PATENT DOCUMENTS

| | | | |
|---|---|---|---|
| 1078922 | 3/1989 | Japan | 112/405 |

*Primary Examiner*—Ismael Izaguirre
*Attorney, Agent, or Firm*—Gardere & Wynne, L.L.P.

[57] ABSTRACT

A method of making a child's accessory such as a hooded towel or mitten-type washcloth is disclosed. In one embodiment, the method includes the steps of: cutting a first, generally rectangular fabric blank with an extension projecting from a truncated corner of the rectangular fabric blank; cutting a second, generally triangular fabric blank with an extension projecting from a truncated corner of the triangular fabric blank, the second blank configured to overlay at least a selected portion of the first blank, the second blank having a first and second side; imprinting a design on the first side of the second blank of fabric, the edges of the design defining a first perimeter; inverting the second blank of fabric; outlining a second perimeter inside of, and substantially parallel to, at least a portion of the first perimeter on the second side of the second blank of fabric, the outline comprising a seam line; overlaying the second blank of fabric onto the first blank of fabric; attaching the second blank of fabric to the first blank of fabric along the seam line to form an envelop-like structure; removing excess fabric from the first and second blank; inverting the envelop-like structure; stitching across at least a portion of the inverted envelop-like structure to form a fanciful design including decorative ear-like projections.

20 Claims, 5 Drawing Sheets

METHOD OF MAKING A CHILD'S ACCESSORY

TECHNICAL FIELD

The present invention relates to a method of making a child's accessory such as a towel, blanket, mitten, cap, bootie, puppet or washcloth incorporating a fanciful figure.

BACKGROUND OF THE INVENTION

Children's accessories such as hooded towels, blankets, mittens, caps, booties, puppets and mitten-type washcloths are popular items, especially so when such accessories incorporate or are in the form of fanciful figures designed to appeal to children. For example, a towel or blanket might include a hood formed in the shape of an animal, a hat, a house or some other figure designed to appeal to a child's imagination. Similarly, a mitten-type washcloth may be formed in the shape of a fanciful figure designed to capture the imagination of a child. Thus, common articles such as towels, washcloths, and similar articles can be transformed into accessories designed to please and distract children. Manufacturing such items, however, has proved difficult for a number of reasons.

Typically children's accessories such as hooded towels and mitten-type washcloths are formed from several pieces of fabric corresponding to different portions of the accessory. For example, if the figure incorporates ears or ear-like protrusions, the protrusions are generally formed separately and sewn into the seam joining other parts of the accessory. This procedure is, however, time and labor intensive. Additionally, when this method is used it is difficult to uniformly position the ears or ear-like like projections in the seam joining the other pieces of fabric together. Consequently, in many cases the ears or ear-like projections are skewed, asymmetrically positioned or not completely sewn into the seam in which case the finished accessory is not functionally or aesthetically acceptable. Moreover, even when the ears or ear-like projections are positioned symmetrically and correctly sewn into the seam, the appearance of the finished accessory is not totally satisfactory.

Thus, there is a need for an improved method of making children's accessories incorporating fanciful designs that overcomes the foregoing shortcomings.

SUMMARY OF THE INVENTION

The present invention provides an improved method of making children's accessories incorporating fanciful figures or other images designed to appeal to children. The improved method reduces the amount of time and labor required to manufacture such accessories and produces an aesthetically appealing, uniform product. The method of the present invention generally involves the steps of: cutting a first blank from a fabric; cutting a second blank of fabric configured to overlay a least a portion of the first blank, the second blank being sized to accommodate a preselected design; imprinting the preselected design or image on a first side of the second blank using a process such as silkscreening, stitching, applying an applique, embroidery, stitched embroidery, sublimation from a paper transfer using heat or printing, the design defining a first perimeter; inverting the second blank; tracing or outlining a second perimeter inside of, and substantially parallel to the first perimeter to form a seam line; positioning the second blank over at least a selected portion of the first blank with the first side of the second blank against the first blank; attaching the first blank to the second blank along at least a portion of the seam line to form a pocket-like or envelop structure; removing excess fabric extending beyond the seam line; inverting the pocket-like or envelop structure; and stitching at least a portion of the inverted envelop to form a fanciful figure such as an animal or a hat. In one embodiment, the improved method uses two pieces of fabric to form a hooded towel wherein the hood is integrally formed from the fabric and comprises a fanciful figure such as an animal with ears or ear-like projections. In a second embodiment, the improved method uses two pieces of fabric to form a mitten-type washcloth for a child comprising a fanciful figure integrally formed from two pieces of fabric.

BRIEF DESCRIPTION OF THE DRAWINGS

A more complete understanding of the present invention may be had by reference to the following Detailed Description when taken in conjunction with the accompanying drawings wherein like reference characters denote like or similar parts throughout the figures.

DETAILED DESCRIPTION OF THE DRAWINGS

As described in detail below, the present invention provides an improved method of making children's accessories incorporating fanciful figures or other images designed to appeal to children. Use of the method produces an aesthetically appealing, uniform product. The method of the invention also reduces the amount of time and labor required to manufacture such accessories. The improved method generally involves the following steps: 1. cutting a first blank from a suitable fabric; 2. cutting a second blank of fabric configured to overlay at least a portion of the first blank, the second blank being sized to accommodate a preselected design; 3. imprinting the preselected design on a first side of the second blank using a process such as silkscreening, the design defining a first perimeter; 4. inverting the second blank; 5. outlining a second perimeter inside of, and substantially parallel to, the first perimeter to form a seam line; 6. positioning the second blank over at least a selected portion of the first blank with the first side of the second blank against the first blank; 7. attaching the first blank to the second blank along at least a portion of the seam line to form an envelop or pocket-like structure; 8. removing excess fabric from the first and second blanks; 9. inverting the envelop or pocket-like structure; and 10. stitching at least a portion of the inverted envelop or pocket-like structure to form a fanciful figure such as an animal or a hat.

Figure 1:
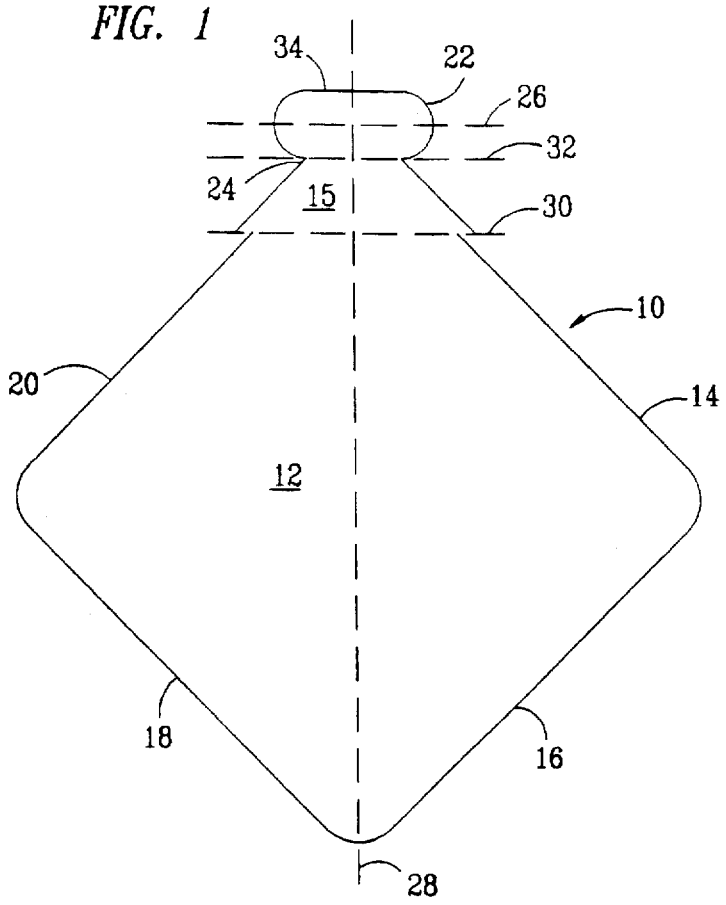
FIG. 1 is a perspective view of a first blank of fabric cut in accordance with one embodiment of the method of the present invention.

Referring now to FIG. 1, there is illustrated a first fabric blank 10 cut from a material suitable for use as a towel or blanket such as terry cloth, cotton, polyester, wool or other suitable fabrics. The blank 10 comprises a generally rectangular shape with a body portion 12 with sides 14, 16, 18, and 20 and an extension 22 projecting from a truncated corner 24 of the blank. As illustrated, the extension 22 is generally oval, however, the extension could be formed in the shape of a triangle, square, circle or other geometry as appropriate depending upon the desired appearance of the finished product. Similarly, the generally rectangular body portion 12 of blank 10 could be circular, triangular, or formed in some other symmetrical or non-symmetrical geometry as appropriate depending upon the desired end product.

As shown the longitudinal axis 26 of the extension 22 is perpendicular to, and bisected by, diagonal axis 28 of the body portion 12. The extension 22 along with the adjacent body portion 15 located between horizontal axes 30 and 32 comprises a figure-forming portion 34 of the first blank 10.

Figure 2:
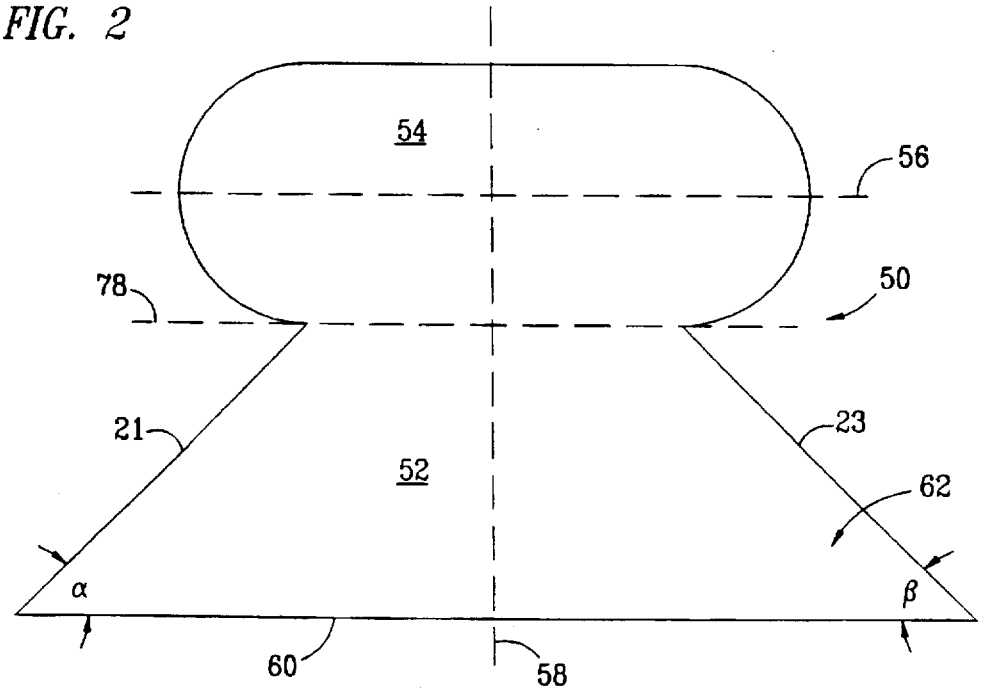
FIG. 2 is a perspective view of a second blank of fabric cut in accordance with one embodiment of the method of the present invention.

A second fabric blank 50 is shown in FIG. 2. The second blank 50 includes a first side 62, truncated lower body portion 52 formed generally in the shape of a truncated isosceles triangle with sides 21 and 23 and with angles $\alpha$ and $\beta$ being substantially equal. The second blank 50 is substantially identical to the figure forming portion 34 of the first blank 10 in terms of size and geometry. An extension 54 of the blank 50 extends above horizontal axis 78 upwardly from the truncated lower body portion 52 of the blank. As in the case of the first blank, the extension is illustrated as substantially oval, but it is contemplated that other geometries would be suitable depending on the desired appearance of the finished product. The extension 54 is the same or substantially the same size and geometry as the extension 22 of the first blank 10 and the longitudinal axis 56 of the extension 54 is substantially perpendicular to a line 58 that is perpendicular to, and bisects the base 60 of the blank.

Figure 3:
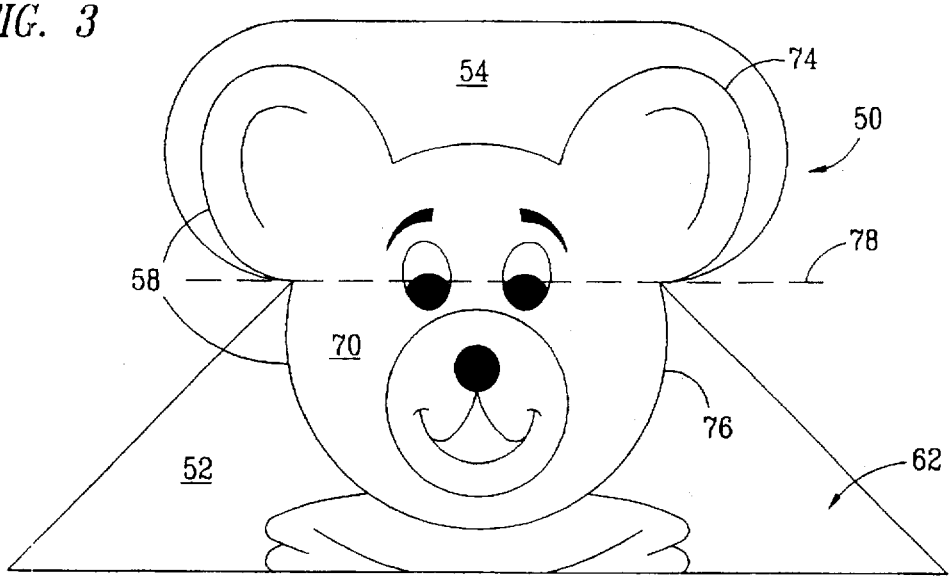
FIG. 3 is a top view of the second blank of fabric with a fanciful figure or design imprinted on the blank.

Referring now to FIG. 3, the second blank 50 is illustrated with a fanciful design 70 imprinted or superimposed upon a first side 62 of the blank. As illustrated, the fanciful design or FIG. 70 is a reproduction of a smiling bear face, however, it will be appreciated that numerous other designs could be applied to the blank 50 as desired. The fanciful design 70 includes an upper portion 74 corresponding to the extension 54 of the blank 50, and a lower portion 76, the edges of which together define a perimeter or outline 58 corresponding to the exterior edge of the design. In the embodiment illustrated, the extension 54 of the blank 50 has been sized to accommodate the portion of the design extending above horizontal axis 78 which separates the truncated triangular lower body portion 52 of the blank from extension 54.

The fanciful design 70 may be imprinted on the blank 50 using conventional processes such as such as silkscreening, stitching, painting, applying a an applique, embroidering, printing, stitched embroidering or sublimation from a paper transfer using heat. In one embodiment of the method of the present invention, the fanciful design or image is applied using silk screening (serigraphic) techniques. Although silk screening techniques are well known to those skilled in the art the technique will be briefly described for the purposes of clarity.

In a typical silk screening process, a dye or paint is applied to a fabric using a screen to apply a paint or dye to selected portions of the fabric. The fabric screen is first stretched over a frame. The screen is formed from a permeable fabric that is initially coated with a photo-reactive material. The photo-reactive material, when cured by exposure to a light source, is insoluble in the dye or paint. The particular design or pattern to be imprinted on the fabric is applied to a transparent sheet of material such as acetate or plastic with an opaque material such as paint. Alternatively, the design or pattern may be cut from an opaque material and applied to the transparent sheet. The transparent sheet with the applied design or pattern is placed over the coated permeable fabric and the fabric is exposed to light for a period sufficient to cure the exposed photo reactive material. After the photo reactive material is cured, the transparent sheet is removed. The uncured photo reactive material on the portion of the coated fabric that was shielded from the light source under the opaque design or image is removed using a suitable solvent. The frame is placed over the fabric to which the pattern is to be applied and paint or dye is then applied to the screen. The paint or dye passes through the portion of the screen corresponding to the image or design to be applied, dyeing the underlying fabric. Multiple screens are used to overlay different designs and colors onto the fabric. Although one method of imprinting a fanciful design has been described, it will be appreciated that other methods may be employed to imprint the fanciful design onto the blank 50.

Figure 4:
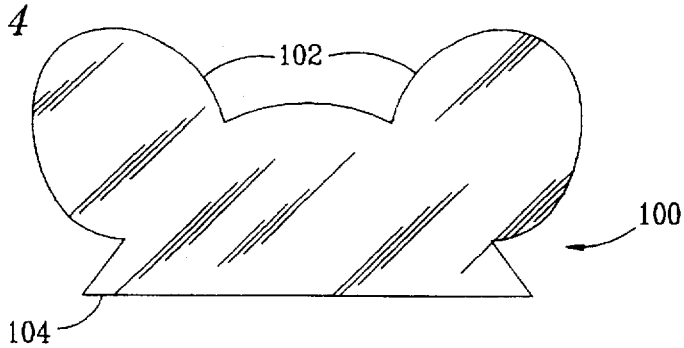
FIG. 4 is a top view of a pattern or template used in conjunction with one embodiment of the method of the present invention.
Figure 5:
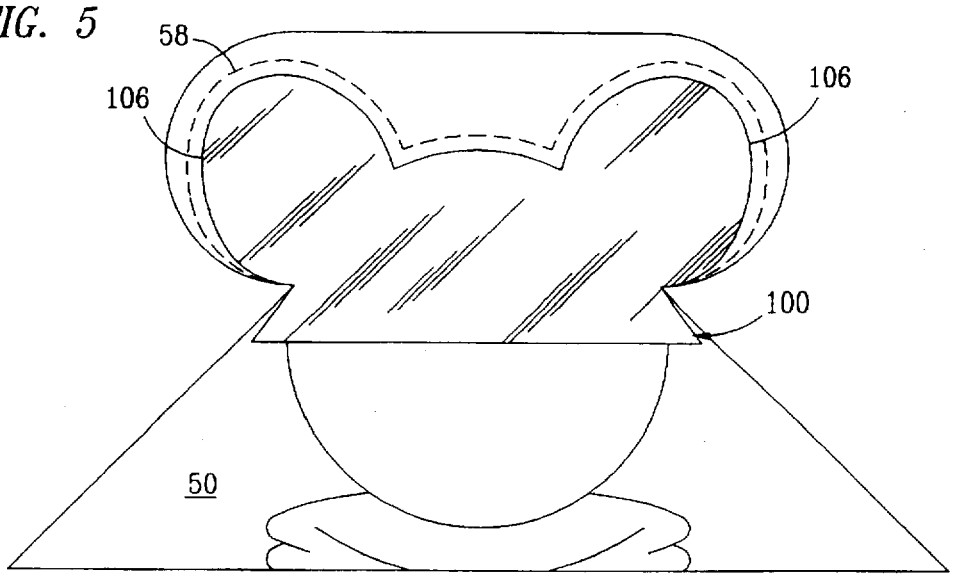
FIG. 5 is a top view of the pattern or template of FIG. 4 positioned on top of the second blank of fabric.

Referring now to FIGS. 4 and 5, there is illustrated a template or pattern 100 used in one embodiment of the present invention. As shown, the pattern 100 is formed in the same general shape as the upper portion of the perimeter 58 of the fanciful design 70, except that the pattern is sightly smaller than the upper portion 74 of the design. The template or pattern 100 includes upper edge 102 and base 104. Preferably, the pattern 100 is formed from a rigid or semi-rigid transparent plastic material such as a sheet of acetate or plastic.

Figure 6:
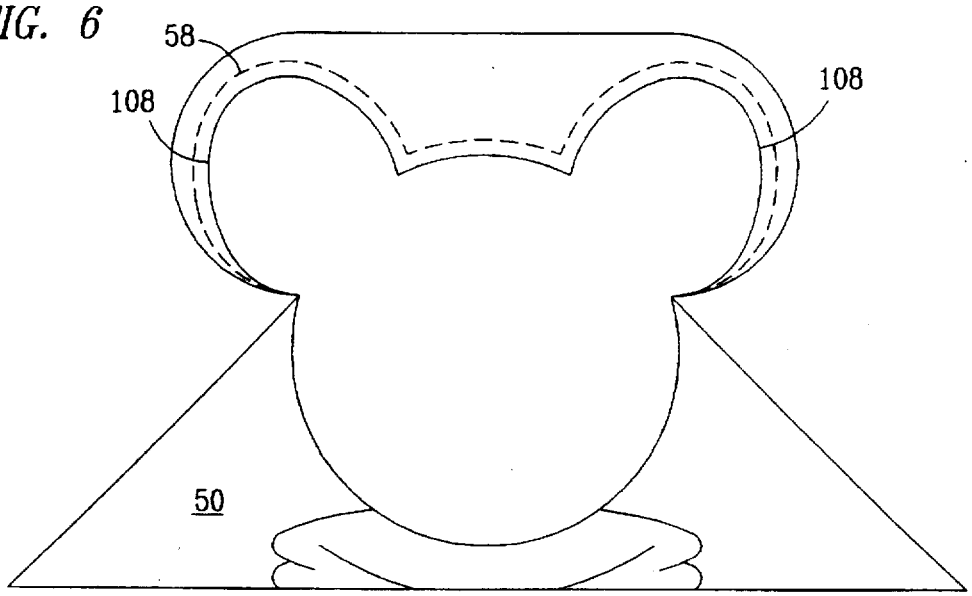
FIG. 6 is a bottom view of the second blank of fabric with a seam line inscribed on the blank.

As best illustrated in FIGS. 5 and 6, the blank 50 is placed with first side 62, bearing the fanciful design, down. The pattern 100 is placed on top of the blank 50 and positioned within the inside of the upper portion of perimeter 58 (illustrated with broken line) defined by the upper portion 74 of the fanciful design 70. In this position, the upper edge 102 of the pattern 100 defines a profile 106 on blank 50 that is sightly smaller and substantially parallel to the upper portion of perimeter 58, as defined by the upper portion 74 of fanciful design 70. After the pattern 100 is positioned with the upper edge 102 of the pattern substantially parallel to upper portion of perimeter 58, the profile 106 is traced with a pen or other suitable marking tool to inscribe a seam line 108 corresponding to profile 106. The use of a rigid or semi-rigid material in the fabrication of the pattern 100 aids in the inscription of the seam line 108 and produces a more consistent seam line.

Referring now to FIG. 6, the pattern 100 is removed from the blank 50. Seam line 108 is positioned inside of and substantially parallel to the upper portion of perimeter 58, as defined by the upper portion 74 of fanciful design 70.

Figure 7:
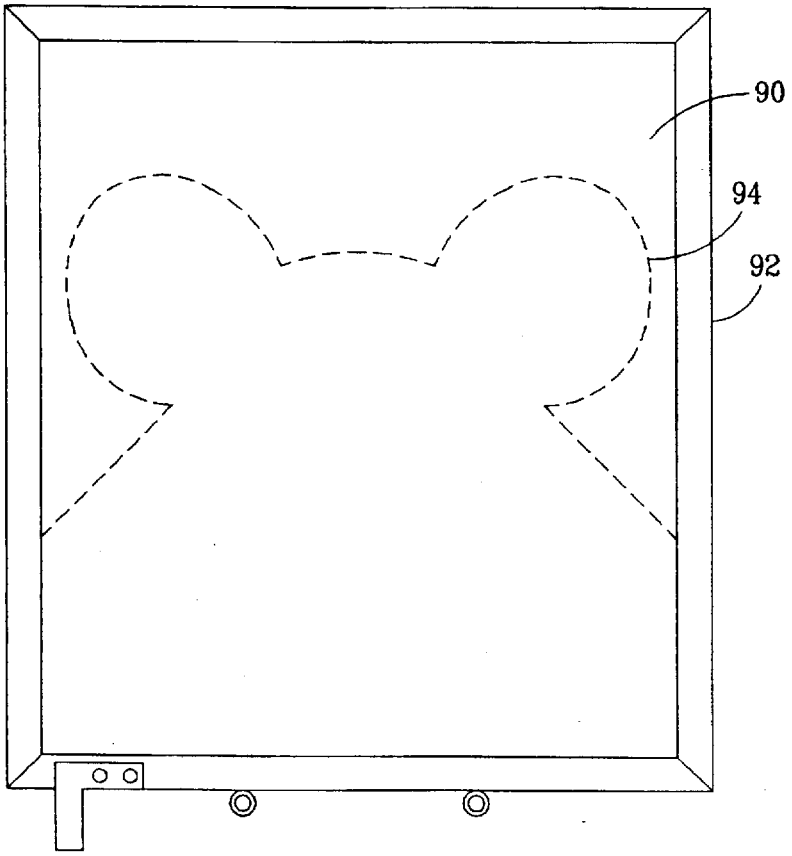
FIG. 7 is a top view of a silk screen mounted in a frame for use in an alternate embodiment of the present invention.
Figure 8:
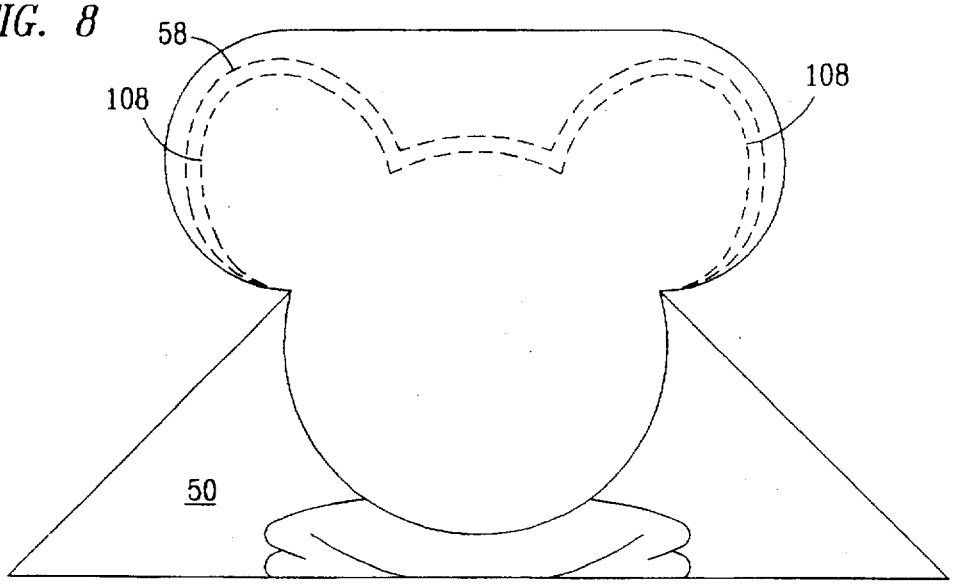
FIG. 8 is a bottom view of the second blank of fabric with a seam line inscribed on the blank.

Referring now to FIGS. 7 and 8 an alternate method of inscribing seam line 108 is described. A silk screen 90 is prepared with a permeable pattern 94 as previously described and mounted on frame 92. As illustrated, the pattern 94 formed on silk screen 90 is a profile of the same general shape as the upper portion of the perimeter 58 of the fanciful design 70, except that the profile is sightly smaller than the upper portion 74 of the design and sightly smaller than the upper portion of perimeter 58, as defined by the upper portion 74 of fanciful design 70. The frame 92 is aligned over the blank 50 with the pattern 94 inside of, and substantially parallel to, the upper portion of perimeter 58. Ink or dye is applied to the silk screen 90, passes through pattern 94 and forms a seam line 108 on blank 50 as illustrated in FIG. 10.

Figure 9:
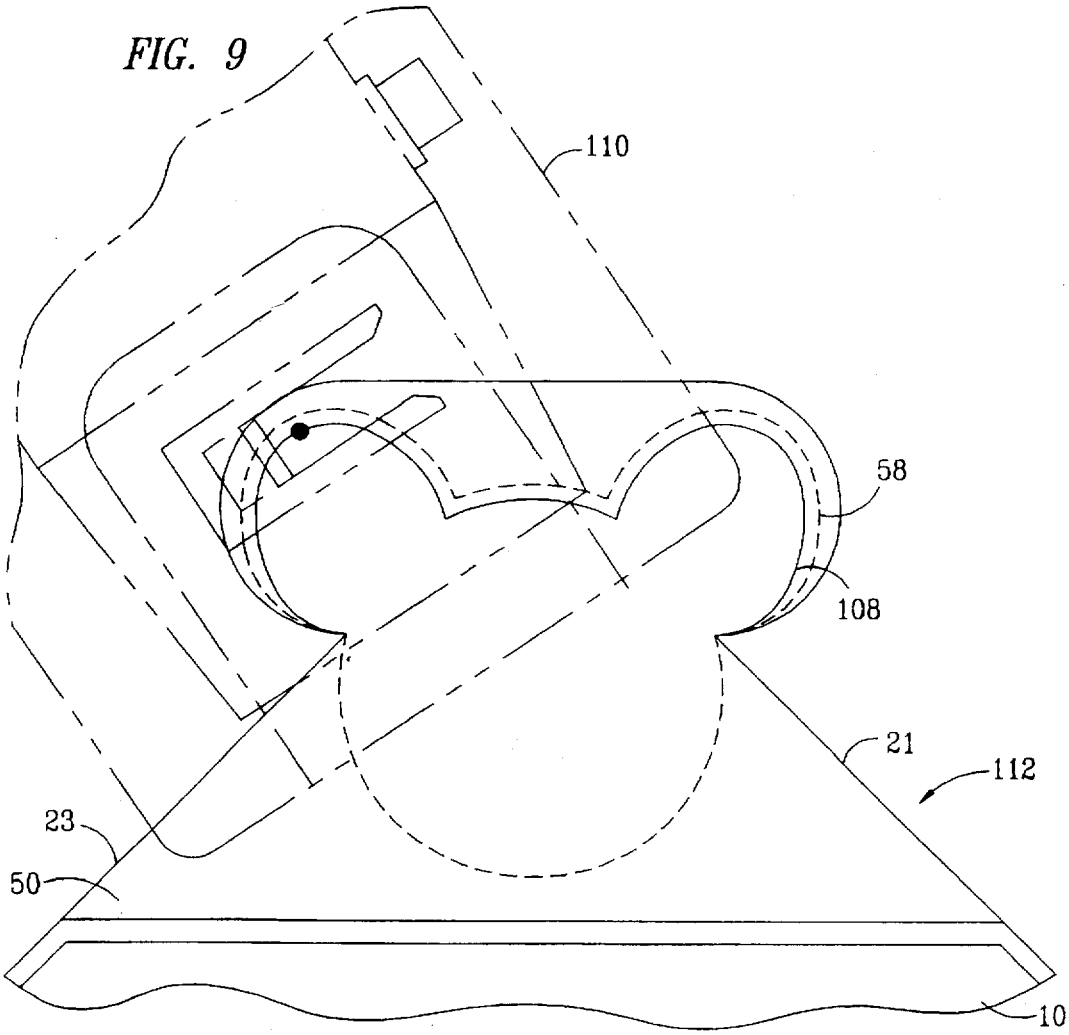
FIG. 9 is a view of the second blank of fabric being sewn to the first blank of fabric.
Figure 10:
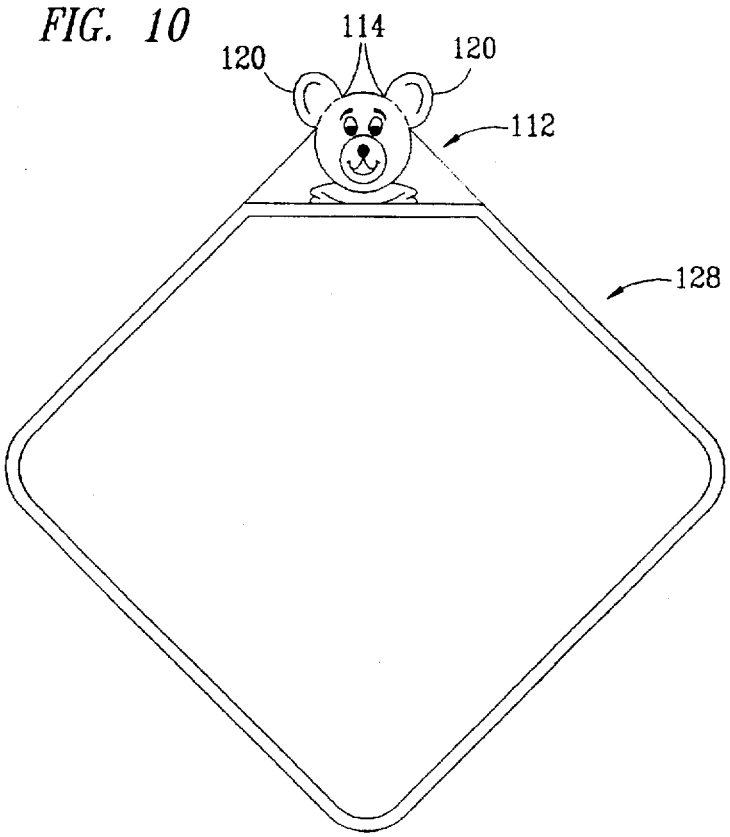
FIG. 10 is a top view of a first child's accessory, i.e. a hooded towel or blanket, made in accordance with the method of the present invention.

Referring now to FIGS. 9 and 10, the second blank 50 is placed over the corresponding figure-forming portion 34 of the first blank 10 with the first side 62 of blank 50 against first blank 10. The two blanks are then inserted into a sewing machine 110 and the second blank 50 is sewn to first blank 10 along edges 21 and 23 with an interlock or single stitch and across seam line 108 with a single line stitch to form a pocket or envelop-like structure 112 including decorative projections or ear-like structures 120. Excess fabric is then trimmed from the extensions 14 and 24 to form and the pocket is inverted to expose the fanciful design 70.

As best illustrated in FIG. 10, at least a portion of the inverted pocket 112 is stitched to complete the fanciful figure, including decorative ear-like projections 120. As illustrated, a line of stitching 114 is sewn across the base of each of the projections or ear-like structures 120. The lines of stitching 114 function to complete the overall aesthetic appearance of the fanciful figure. The resulting child's accessory, a hooded blanket 128, is aesthetically pleasing and designed to appeal to a child's imagination.

Figure 11:
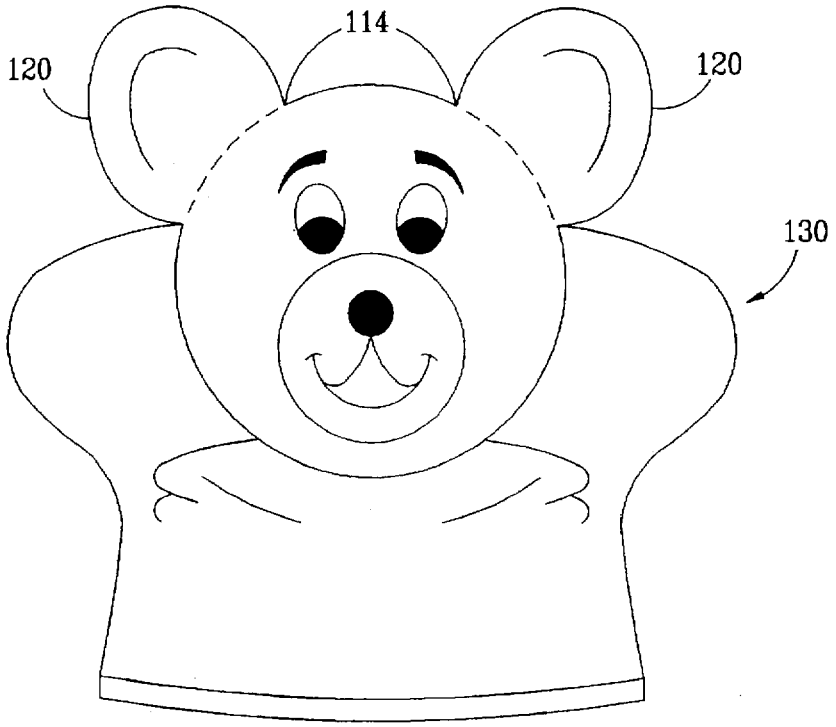
FIG. 11 is a top view of a second child's accessory, i.e. a mitten or washcloth, made in accordance with the method of the present invention.

Referring now to FIG. 11, there is illustrated a child's accessory 130 comprising a mitten, mitten-type washcloth or a puppet. The accessory is manufactured in the same fashion as described above, except that the geometry of the first and second fabric blanks is identical. As in the case of the hooded blanket 120, a pattern 100 or silk screen 90 is used to inscribe a seam line, the blanks are sewn together along the seam line, excess fabric is trimmed and the sewn-together blanks are inverted. The final step in the process is to sew a line of stitching 114 across the base of each of the ears 120 to complete the overall aesthetic appearance of the fanciful figure.

Although various embodiments of the present invention have been illustrated in the accompanying Drawings and described in the foregoing Detailed Description, it will be understood that the invention is not limited to the embodiments disclosed but as will be appreciated by those skilled in the art, the invention is susceptible to numerous modifications and variations without departing from the spirit and scope of the invention as hereinafter claimed.

We claim:

1. A method of making an accessory comprising the steps of:

cutting a first blank of fabric;

cutting a second blank of fabric, the second blank configured to overlay at least a selected portion of said first blank, the second blank having a first and second side;

imprinting a design on the first side of the second blank of fabric, the edges of the design defining a first perimeter;

inverting the second blank of fabric;

outlining a second perimeter inside of, and substantially parallel to, at least a portion of the first perimeter on the second side of the second blank of fabric, the outline comprising a seam line;

overlaying the second blank of fabric onto the first blank of fabric;

attaching the second blank of fabric to the first blank of fabric along the seam line to form an envelop-like structure;

removing excess fabric from the first and second blank;

inverting the envelop like structure;

stitching across at least a portion of the inverted envelop-like structure to form a fanciful design.

2. The method of claim 1 wherein the step of outlining a second perimeter inside of, and substantially parallel to, the first perimeter on the second side of the second blank of fabric comprises inscribing a seam line by tracing at least a portion of a pattern.

3. The method of claim 2 wherein the pattern consists of a piece of semi-rigid transparent material.

4. The method of claim 1 wherein the step of outlining a second perimeter inside of, and substantially parallel to, the first perimeter on the second side of the second blank of fabric comprises using a silk screen pattern to form a seam line.

5. The method of claim 1, wherein the step of cutting a first blank of fabric comprises cutting a generally rectangular fabric blank with an extension projecting from a truncated corner of the rectangular fabric blank.

6. The method of claim 5 wherein the step of cutting a generally rectangular fabric blank with an extension projecting from a truncated corner of the rectangular fabric blank further comprises forming the extension with a longitudinal axis substantially perpendicular to a diagonal axis of the rectangular blank.

7. The method of claim 1 wherein the step of cutting a second blank of fabric comprises cutting a generally triangular fabric blank with an extension projecting from a truncated corner of the triangular fabric blank.

8. The method of claim 6 wherein the step of cutting a generally triangular fabric blank with an extension projecting from a truncated corner of the triangular fabric blank comprises forming an extension with a longitudinal axis substantially perpendicular to an axis bisecting the base of the triangular fabric blank.

9. The method of claim 1 wherein the first blank of fabric and the second blank of fabric are geometrically identical.

10. A method of making an accessory comprising the steps of:

cutting a first, generally rectangular fabric blank with an extension projecting from a truncated corner of the rectangular fabric blank;

cutting a second, generally triangular fabric blank with an extension projecting from a truncated corner of the triangular fabric blank, the second blank configured to overlay at least a selected portion of said first blank, the second blank having a first and second side;

imprinting a design on the first side of the second blank of fabric, the edges of the design defining a first perimeter;

inverting the second blank of fabric;

outlining a second perimeter inside of, and substantially parallel to, at least a portion of the first perimeter on the second side of the second blank of fabric, the outline comprising a seam line;

overlaying the second blank of fabric onto the first blank of fabric;

attaching the second blank of fabric to the first blank of fabric along the seam line to form an envelop-like structure;

removing excess fabric from the first and second blank;

inverting the envelop like structure;

stitching across at least a portion of the inverted envelop-like structure to form a fanciful design.

11. The method of claim 10 wherein the step of outlining a second perimeter inside of, and substantially parallel to, the first perimeter on the second side of the second blank of fabric comprises inscribing a seam line by tracing at least a portion of a pattern.

12. The method of claim 10 wherein the pattern consists of a piece of semi-rigid transparent material.

13. The method of claim 10 wherein the step of outlining a second perimeter inside of, and substantially parallel to, the first perimeter on the second side of the second blank of fabric comprises using a silk screen pattern to form a seam line.

14. The method of claim 10 wherein the step of cutting a generally rectangular fabric blank with an extension projecting from a truncated corner of the rectangular fabric blank further comprises forming the extension with a longitudinal axis substantially perpendicular to a diagonal axis of the rectangular blank.

15. The method of claim 10 wherein the step of cutting a generally triangular fabric blank with an extension projecting from a truncated corner of the triangular fabric blank comprises forming an extension with a longitudinal axis substantially perpendicular to an axis bisecting the base of the triangular fabric blank.

16. The method of claim 10 wherein the step of stitching across at least a portion of the inverted envelop-like structure to form a fanciful design comprises stitching across the base of ear-like projections.

17. The method of claim 10 wherein the step of attaching the second blank of fabric to the first blank of fabric along the seam line to form an envelop-like structure further comprises the step of forming ear-like projections.

18. A method of making an accessory comprising the steps of:

cutting a first, generally rectangular fabric blank with an extension projecting from a truncated corner of the rectangular fabric blank;

cutting a second, generally triangular fabric blank with an extension projecting from a truncated corner of the triangular fabric blank, the second blank configured to overlay at least a selected portion of said first blank, the second blank having a first and second side;

imprinting a design on the first side of the second blank of fabric, the edges of the design defining a first perimeter;

inverting the second blank of fabric;

outlining a second perimeter inside of, and substantially parallel to, at least a portion of the first perimeter on the second side of the second blank of fabric, the outline comprising a seam line;

overlaying the second blank of fabric onto the first blank of fabric;

attaching the second blank of fabric to the first blank of fabric along the seam line to form an envelop-like structure including ear-like projections.;

removing excess fabric from the first and second blank;

inverting the envelop like structure;

stitching across at least a portion of the inverted envelop-like structure to form a fanciful design.

19. The method of claim 18 wherein the step of outlining a second perimeter inside of, and substantially parallel to, the first perimeter on the second side of the second blank of fabric comprises using a silk screen pattern to form a seam line.

20. The method of claim 18 wherein the step of outlining a second perimeter inside of, and substantially parallel to, the first perimeter on the second side of the second blank of fabric comprises inscribing a seam line by tracing at least a portion of a pattern formed from a semi-rigid transparent material.

* * * * *